United States Patent [19]

Ormanns et al.

[11] Patent Number: 4,495,495

[45] Date of Patent: Jan. 22, 1985

[54] STAFF-LOCATION AND SIGNALLING SYSTEM FOR USE IN MINES

[75] Inventors: Siegfried Ormanns, Gelsenkirchen; Helmut Neumann, Dortmund, both of Fed. Rep. of Germany

[73] Assignee: Ruhrkohle Aktiengesellschaft, Essen, Fed. Rep. of Germany

[21] Appl. No.: 340,017

[22] Filed: Jan. 18, 1982

[30] Foreign Application Priority Data

Jul. 20, 1981 [DE] Fed. Rep. of Germany ..... 3101542

[51] Int. Cl.[3] ..... G08B 5/22

[52] U.S. Cl. ..... 340/825.45; 340/825.49; 340/321; 340/539; 340/825.69; 455/7; 455/11

[58] Field of Search ..... 340/825.45, 825.46, 340/825.47, 825.48, 825.49, 825.44, 825.66, 825.69, 825.72, 539, 531, 572, 321; 455/7, 11-13, 53, 54, 100, 81, 73, 80, 88-90

[56] References Cited

U.S. PATENT DOCUMENTS

| | | | |
|---|---|---|---|
| 3,302,113 | 1/1967 | Clay | 340/825.54 |
| 3,668,526 | 6/1972 | Raskin | 340/539 |
| 3,914,692 | 10/1975 | Seaborn, Jr. | 340/539 |
| 3,946,315 | 3/1976 | Tustison | 455/7 |
| 3,955,140 | 5/1976 | Stephens et al. | 455/11 |
| 4,242,614 | 12/1980 | Vatis et al. | 340/825.69 |

OTHER PUBLICATIONS

"Underground Radio-Telephone", Silec, DSI, Division Signalization Industry, France, 1980.

*Primary Examiner*—Donnie L. Crosland

[57] ABSTRACT

A staff-location and signal system for mines, in which conventional radio telephone devices can be used for producing a radio telephone connection between an exchange and base stations or between the base stations and radio telephone equipment in the mine area. All underground employees, whether they carry radio telephones or not, can be reached by warning signals or staff-location signals sent via apparatus carried by the employees. To this end, the miner's lamps are associated with radio receivers which respond to cooled signals transmitted by the base station and thereupon actuate a switching device. The normally-closed working-current circuit of the lamp contains a switch which can be operated by the actuated switching device so that it switches the miner's lamp on and off. In this manner all miners can be raised when necessary by warning or staff-location signals in the form of flashes. Alternatively, switching devices actuated by the coded radio signals can be associated with some lamps in the general lighting system so as to provide warning signals which are clearly visible even in strongly-illuminated areas.

19 Claims, 2 Drawing Figures

SHAFT
A
7
LAMP
5
BASE
STATION
1
3
RELAY STATION
2
6
5
7
5
LAMP
6

5
PORTABLE RADIO SET
4
RELAY STATION
2
7
5
LAMP
5
LAMP
7
BASE STATION
1
3
7
RELAY
STATION
2
SHAFT
B

STAFF-LOCATION AND SIGNALLING SYSTEM FOR USE IN MINES

BACKGROUND OF THE INVENTION

The invention relates to a staff-location and signalling system for use in mines, and more particularly the invention relates to a system comprising one or more base stations distributed over the mine area, the base stations being in voice communication with an exchange and each having a receiving and transmitting device and being adapted for selective coupling, indirectly via secondary wave guides, to radio telephone sets in the mine area in order to produce radio telephone traffic.

In some known systems of the aforementioned kind, used as radio telephone and signalling systems, a radio telephone connection can be made either between an exchange and one or more base stations or between the base stations and radio telephone sets carried by miners in the mine. Compared with omnidirectional systems, systems of the aforementioned kind have the advantage of much greater range, since electromagnetic waves between the parties in communication are transmitted over great distances along secondary wave guides extending through the entire main area. The wave guides may be, for example, transmission lines; metal, water/or compressed-air lines; chains; or rails or the like. The advantage compared with conventional induction radio installations is that there is no need for special wave guides between subscriber stations in the mine area.

However, a voice or signal communication from the exchange or base station can be made only to those miners who carry a radio telephone set. Consequently these are the only people who can be reached by a staff-location or warning signal. For ergonomic and economic reasons, however, it is impossible to equip all mine employees with radio telephone sets.

The object of the invention, therefore, is to provide an improved staff-location and signalling system.

SUMMARY OF THE INVENTION

Accordingly, one aspect of the invention provides a staff-location and signalling system for operation in a mine, comprising: at least one base station adapted to be located in the mine area and comprising a transmitter for transmitting radio signals; at least one secondary wave-guide adapted to extend through at least part of the mine area for transmitting radio signals between the said at least one base station and at least one first signal receiver at a distance therefrom adapted to be associated with a miner's lamp carried by a person in the mine area and to respond to coded radio signals transmitted by a said base station, the or each first signal receiver being adapted to open and close a normally-closed working-current circuit connecting the said associated miner's lamp to a source of working current, so that the miner's lamp can be switched on and off in accordance with the said radio signals.

A second aspect of the invention provides a system for producing voice and signal connections in mines, the system comprising: an exchange; at least one base station in the mine area which base station is adapted to be in voice communication with the exchange and which has a transmitting and receiving device and associated antenna means and can be selectively coupled via secondary wave-guides to radio telephone sets in the mine area in order to produce radio telephone traffic; and a plurality of first signal receivers adapted to be carried respectively with a miner's lamp by miners in the mine area and adapted to respond to coded radio signals transmitted by a base station via secondary wave-guides through the mine area, each of the first signal receivers having a respective switching device adapted to open and close a working-current circuit connecting the associated miner's lamp to a working-current source, the miner's lamp being switchable on and off in accordance with the said coded radio signals to give staff-location or warning signals.

A third aspect of the invention provides a system for producing light signals for miners working in mines, the system comprising: a miner's lamp which, by the use of carrying means, can be attached to a person carrying it so that the lamp illuminates an area in the field of vision of the person, the lamp being selectively connectable to a working-current source via a working-current circuit; a radio receiver having a receiving antenna and adapted to receive coded radio signals; and a switching device actuated by the radio receiver and located in the working-current circuit of the miner's lamp, the switching device being adapted to be actuated in accordance with coded radio signals received by the receiver so that the working-current circuit is automatically opened and closed and the miner's lamp is switched on and off to give signals.

A fourth aspect of the invention provides a staff-location and signalling system in combination with a voice and signalling system for mines, the system comprising: an exchange; at least one base station in voice communication with the exchange and located in the mine area and comprising a transmitting and receiving device with associated antenna means and adapted to be selectively coupled via at least one secondary wave guide to at least one radio telephone set in the mine area in order to produce radio telephone traffic, at least one relay station adapted to amplify radio signals transmitted via the or each secondary wave guide and located at preset distances from one another and from the said at least one base station in the mine area; a plurality of first signal receivers, each adapted to be carried together with a respective miner's lamp by miners in the mine area and each adapted to respond to coded radio signals transmitted by a said base station via the secondary wave guide in the mine area to be received by an antenna of a said first signal radio receiver, the signal receivers each having a respective switching device coupled to the radio receiver and adapted to open and close a working-current circuit connecting the associated miner's lamp to a working-current source; and at least one signal receiver associated with at least one respective group of lamps in a general mine lighting system and adapted to respond to the coded radio signals, the or each second signal transmitter having a signal input and a signal output and being adapted to receive signals transmitted from a said base station via the signal input, and further comprising a switching device coupled to the said signal output and adapted to open and close the supply-current circuit of the said at least one group of lamps in accordance with the coded radio signals, as a result of which the miner's lamps actuated by the first signal receivers and also the lamps in the general lighting system actuated by the second signal receivers can be switched on and off in accordance with the coded radio signals transmitted by the base station, so as to deliver staff-location and warning signals.

By this means it has been found possible for all miners to be supplied when necessary with warning or staff-location signals in the form of clearly visible flashing signals, without using cumbersome, expensive radio telephone sets. If the sequence of flashes is suitably coded, warning signals for all employees can be distinguished from signals for locating individual persons. A person located by an individual code can be given further information by radio telephone via the base communication system or a neighbouring radio telephone or at the nearest base station.

In highly-illuminated areas, the miner may not notice flashing staff- location or warning signals from his own lamp. To prevent this, switching devices actuated by the coded radio signals are preferably associated with at least some lamps in the general lighting system so as to switch those general lamps on and off in accordance with the same code. It is also possible in accordance with the invention to use the same radio signals to actuate acoustic devices, for example the face communication systems, so as to deliver acoustic warning signals.

The switching devices for switching the lamps of the general lighting system on and off can, for example, be incorporated in the monitoring system so that they can switch an entire row of lamps as required, particularly when transmitting emergency or warning signals.

DESCRIPTION OF THE INVENTION

FIG. 1 is a diagrammatic view of part of a mine area in which a staff-location and signalling system in accordance with the invention is used; and FIG. 2 is a block diagram of an embodiment of the staff-location and signalling system comprising an exchange, a base station, a relay or amplifier station, and a receiving unit associated with a miner's lamp.

DETAILED DESCRIPTION

Figure 1:
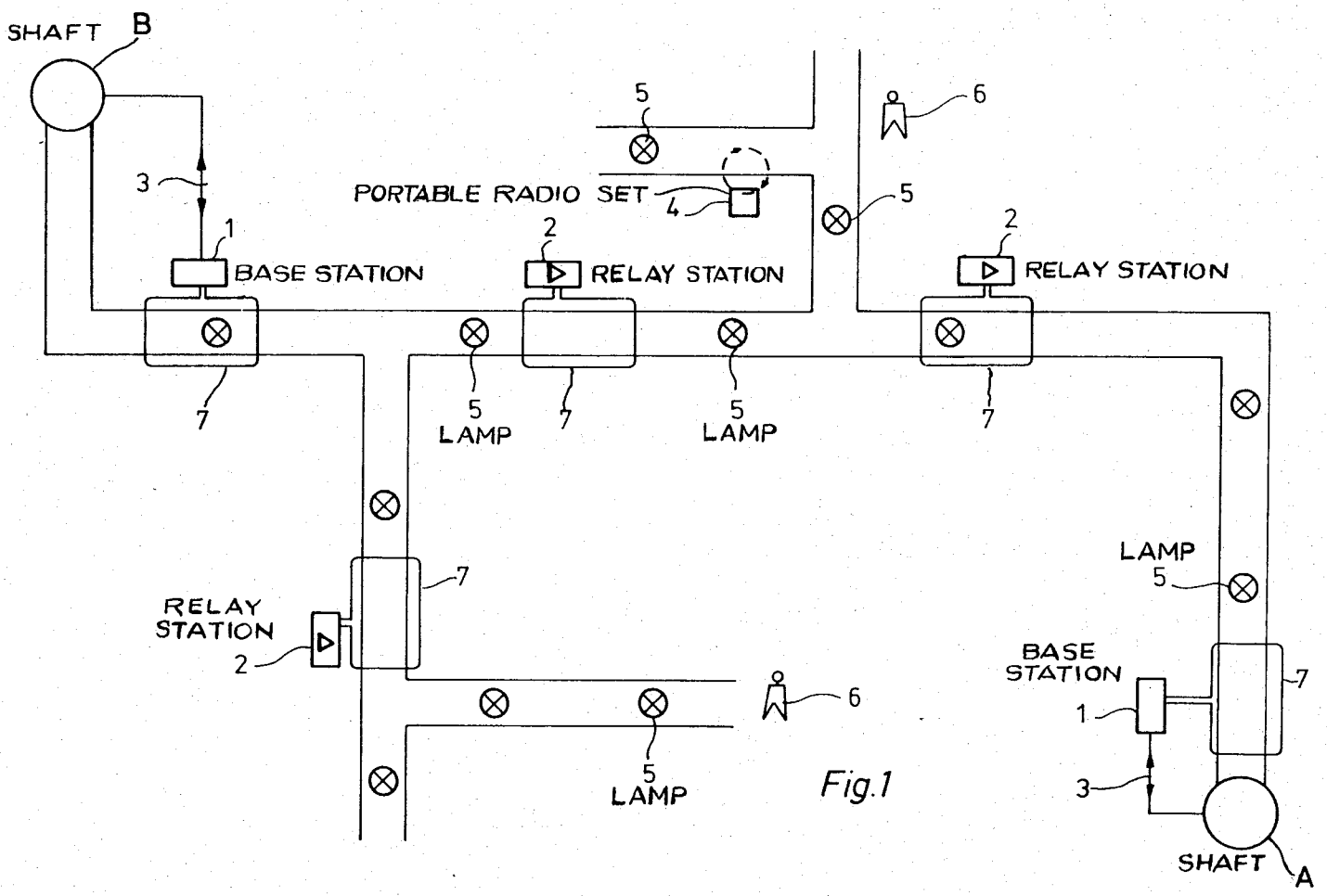

FIG. 1 shows how the main components of a preferred staff-location and signalling system in accordance with the invention are located in a part of a mine area, shown diagrammatically. The system makes use of a conventional radio telephone system for underground operation, in which two base stations 1, each equipped with a transmitting and receiving device, are respectively disposed near two mine shafts A and B and connected to an exchange, which is usually above ground. Voice and signal communication in the mine area from and to the base station is via indirect or secondary wave-guides, i.e. transmission lines, water and compressed-air lines made of steel, or steel cables or chains or rails or the like. The aforementioned secondary wave-guides extend throughout the mine area. Even if some sections are missing, they act like a network of antennae stretching over the entire mine area. Accordingly, suitable amplifier or relay stations 2 are disposed at certain radial intervals of, for example, 1.5 km so as to receive radio signals transmitted from the base stations or to be conveyed to the base stations from the secondary wave-guides, and so as to amplify the signals, filter them to increase the signal/noise ratio if required, and recouple them in the nearest wave-guide.

Figure 2:
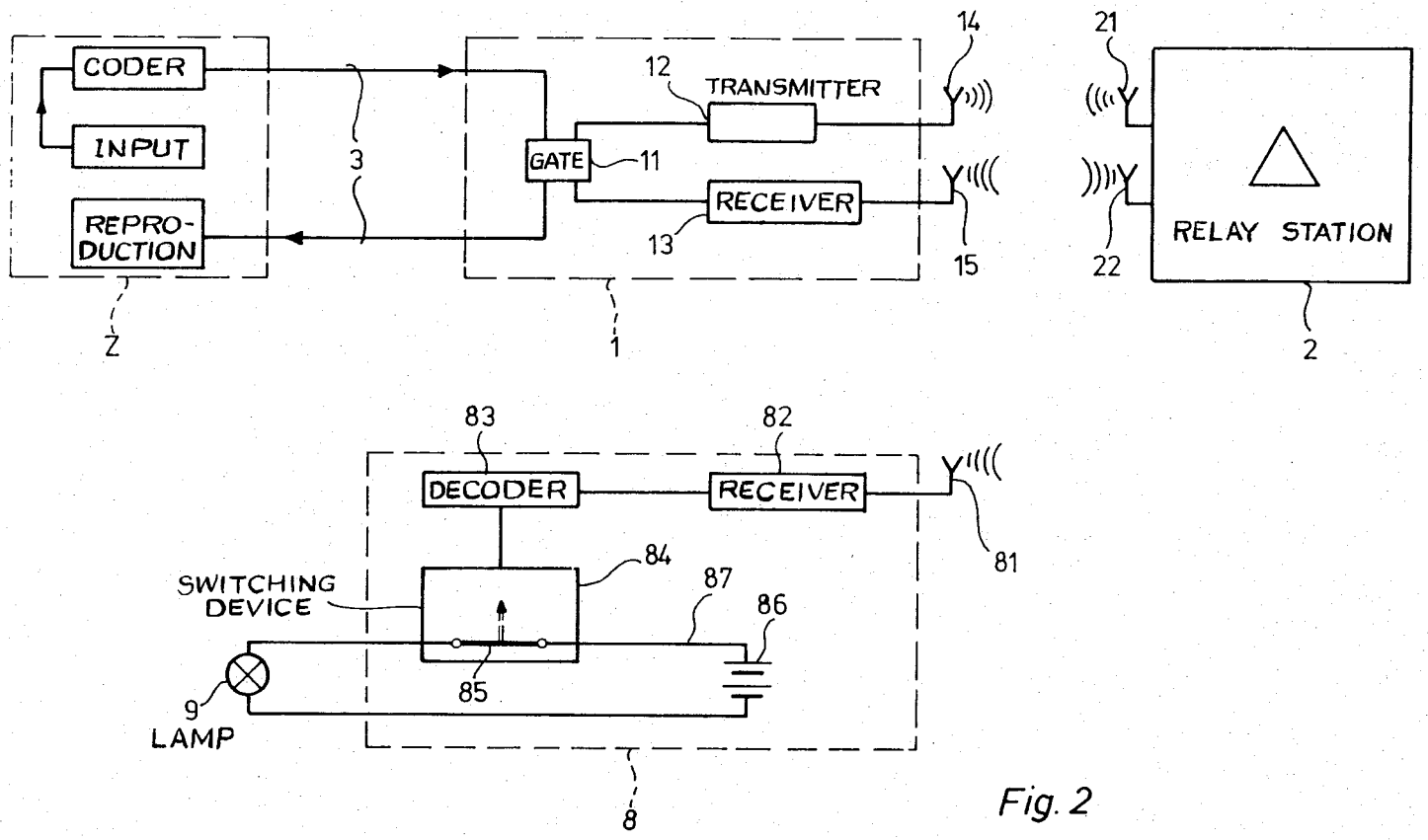

The base stations 1 are preferably connected by lines 3 directly to the above-ground exchange z (FIG. 2). Alternatively they can be coupled to the exchange via the secondary wave-guides.

A portable radio set 4 in a mine can be placed in voice and/or staff-location communication with a base station 1 and (via the base station) with the exchange by means of the secondary wave guides, and, if required, by one or more relay stations 2 after the wave-guide signals have been amplified.

The miners 6 shown diagrammatically in FIG. 1 do not carry portable radio sets, but, by means of staff-location and signal system, they can be supplied with general warning signals and individual staff-location signals from a base station 1. The signals are flashes obtained by switching the individual miners' lamps on and off and usually by also correspondingly flashing at least some of the lamps 5 in the general lighting system. The associated electromagnetic waves are transmitted from the base stattion via secondary wave-guides and, if required, viâ one or more relay stations 2 to a receiver associated with the lamp or with the lamp-battery casing in the same manner as the voice signals are transmitted to the radio sets 4.

In the embodiment shown in FIG. 1, to obtain a particularly advantageous coupling between the base stations 1 or relay stations 2 and the secondary wave-guides in the mine, special antennae 7 extend from the base and rely stations 1 and 2 throughout the mine.

FIG. 2 shows an embodiment of the basic structure of those components of the staff-location and signal system which are used for delivering and transmitting staff-location or warning signals. The exchange z has a keyboard for inputting individual staff-location signals or general information signals. The signals are suitably coded in a coder and transmitted via a connection (a direct line 3 in the illustrated embodiment) to the connected base station, which is on the floor of the mine. The coded staff-location or warning signals are coupled via a suitable gate circuit 11, transmitter 12 and transmitting antennae 14 into the secondary wave-guides in the mine area, and are received by the antennae 22 of the relay stations 2 distributed through the mine area. Therein, the signals are amplified and are then coupled into the secondary wave-guides via the transmitting antennae 21 and transmitted through the wave-guides to the receiving sets carried by the miners.

The receivers 8 are not radio telephone sets which have to be additionally carried, but are directly associated with the miner's lamps or associated lamp-battery casings and are preferably incorporated with all the essential components in the battery casing. The receiving antennae 81 can be located on the connecting line between the battery container and the lamp, or on a strap carrying the battery container or on the lid thereof. Staff-location or warning signals received by the antennae 81 are transmitted by a receiver 82 to a downstream decoder 83 which actuates a switching device 84 in accordance with the signal code initially supplied to, for example, the exchange z. The switching device 84 actuates a switch or switching contact 85 which is made up of normally-closed auxiliary contacts and is located in the working-current circuit 87 between the battery 86 and the lamp 9.

When a staff-location or warning signal is received in the receiver 8, the switching device 84 opens and closes the circuit 87 via the switching contact 85 in accordance with the coded signal as received by the decoder 83, so that the lamp 9 is switched on and off in a predetermined sequence of flashes. The code, in other words the keying sequence for switching the lamp 9 on and off, is such that the person carrying the lamp can recognize the sequence of flashes and can thus discriminate between a staff-location signal and a warning signal.

The decoder 83 may also be so constructed that staff-location signals do not actuate the switching device 84 and thus produce flashes from the lamp 9, unless the code is appropriate. In this manner, the signal can be selectivity transmitted to the persons concerned in the mine area without interfering with differently-coded receivers 8 of other employees. The miner to whom the signal was directed can then make direct telephone contact with the exchange z at a base station or by using an adjacent portable ratio set, in which case the radio telephone signal reaches the reproducing unit in the exchange z via microphone at a base station 1 or via the antenna 15, the receiver 13, the gate 11 and the line 3.

The supply of working current for the receiver 82, the decoder 82, the switching device 84 and, if required, the switching contact 85 of each miner's lamp is obtained from the battery 86. The switching device 84 can be constructed as a relay which, when not actuated, closes the working-circuit current 87 of the lamp 9 via the relay contact. Alternatively the switching contact 85 can be a switching transistor formed from, for example, the output stage of a monostable multivibrator and completely conductive when the coded transmitted signal is not being keyed.

Corresponding receivers 8 are preferably also associated with at least some lamps 5 of the general lighting system, which lamps 5 (see FIG. 1) are also switched on and off by alternately closing and opening the associates supply-current circuit. In this manner, staff-location and warning signals can be recognized in the mine area even by those employees who, as a result of a strong external light source, do not notice the flashing of their own lamps 9.

Warning or staff-location signals may also be directly supplied to the base stations 1, which usually have signal keys.

Although preferred embodiments of the invention have been described hereinbefore and are shown in the drawings, it is expressly stated that the skilled addressee can easily make modifications and changes within the scope of the invention. For example, each signal unit comprising a receiver 8 and miner's lamp 9 may also be actuated by a mobile or stationary radio set independently of a base station, either directly or indirectly via the secondary wave-guides extending through the mine area, the radio set comprising a suitable signal key and adapted to transmit radio signals which can be received by the receiver 8. The electrical energy needed by the receiver 82, the decoder 83 and the switching device 84 carried by each miner may advantageously be obtained from the working-current source, i.e. the battery 88, or the components of the signalling device can all or partly be supplied from a separate power source. The special advantages of preferred embodiments of the invention are that, when necessary, all miners in the mine area can be reached by clearly visible flashes from the lamps which they always carry, and can be supplied with staff-location or warning information. The miners are not loaded with additional equipment which hinders them from working.

What we claim is:

1. A staff-location and signalling system for operation in a mine, comprising:

at least one base station adapted to be located in the mine area and comprising a transmitter for transmitting radio signals;

at least one first signal receiver;

at least one secondary wave-guide adapted to extend through at least part of the mine area for transmitting radio signals between said at least one base station and said first signal receiver at a distance therefrom;

a miner's lamp adapted to be carried by a person in the mine area;

the first signal received being associated with said lamp and adapted to respond to coded radio signals transmitted by said at least one base station; and a normally-closed working-current circuit connecting said associated miner's lamp to a source of working current;

said at least one first signal receiver being adapted to open and close said circuit so that the miner's lamp can be switched off and on in accordance with said coded radio signals.

2. A staff-location and signalling system according to claim 1, wherein each first signal receiver comprises:

a signal input and a signal output, a receiving antenna being coupled to the signal input which antenna is adapted to receive coded radio signals transmitted by a base station and transmitted via the secondary wave-guides; and a switching device, connected to the radio receiver signal output, having a switch located in the said working-current circuit of the miner's lamp, the miner's lamp being adapted to the actuated by the switching device in accordance with the coded radio signals entering the signal input of the radio receiver to open and close the working-current circuit of the miner's lamp.

3. A staff-location and signalling system according to claim 2, in which a respective decoder is connected to each switching device, the decoder being adapted to control a keying pattern for switching the miner's lamp off and on in order to distinguish between warning and individual-location signals in accordance with the coded radio received by the receiver.

4. A staff-location and signalling system according to claim 1, in which at least one second signal receiver adapted to respond to the coded radio signals is associated with at least one lamp in a general mine lighting system, the second signal receiver comprising:

a signal input and a signal output, the radio receiver being adapted to receive radio signals transmitted from a base station via the signal input; and a switching device coupled to the radio receiver signal output and adapted to open and close the supply-current circuit of at least one associated lamp in the general mine lighting system in accordance with the radio signals, so that the lamp is switched on and off in order to deliver staff-location or warning signals.

5. A staff-location and signalling system according to claim 4, in which an entire row of lamps of the general mine lighting system is switched off and on when an appropriate signal is received by the second signal receivers.

6. A staff-location and signalling system according to claim 2 in which the working-current source of the miner's lamp is a battery, and the radio receiver, the switching device and the switch are located together with the battery in a common casing.

7. A staff-location and signalling system according to claim 6, in which a receiving antenna is located at a position selected from the group comprising on a carrying strap, on the connecting line between the battery and the miner's lamp, and on a lid of the battery casing.

8. A staff-location and signalling system according to claim 1, in which at least one relay station equipped with at least one respective transmitting device and at least one respective receiving device and adapted to amplify signals transmitted via the secondary wave-guide is located at a preset radial distance from the said at least one base station in the mine area.

9. A staff-location and signalling system according to claim 1 wherein the base station additionally comprises a receiver for radio signals.

10. A staff-location and signalling system according to claim 9, in which a plurality of base stations is provided together with an exchange, and voice communication is provided between all the stations and the exchange, the base stations being adapted to be selectively coupled, via the secondary wave guides and antennae associated with the transmitters and receivers of the base stations, to radio telephone sets in the mine area in order to produce radio telephone traffic.

11. A system for producing voice and signal connections in mines, the system comprising:

an exchange;

at least one base station in the mine area which base station is adapted to be in voice communication with the exchange and which has a transmitting and receiving device and associated antenna means and can be selectively coupled via secondary wave-guides to radio telephone sets in the mine area in order to produce radio telephone traffic; and a plurality of first signal receivers adapted to carried respectively with a miner's lamp by miners in the mine area and adapted to respond to coded radio signals transmitted by a base station via secondary wave-guides through the mine area, each of the first signal receivers having a respective switching device adapted to open and close a working-current circuit connecting the associated miner's lamp to a working-current source, the miner's lamp being switchable on and off in accordance with the said coded radio signals to give staff-location or warning signals.

12. A system according to claim 11, in which at least one second signal receiver adapted to respond to the coded radio signals is associated with at least one group of lamps in a general mine illumination system, the or each second signal receiver comprising a signal input and a signal output and being adapted to receive the said radio signals transmitted by the said base station via the signal input, the second signal receiver further comprising a respective switching device which is coupled to the said signal output and can open and close the supply-current circuits of the associated respective group of lamps in accordance with the coded radio signals, so that the lamps are switched on and off in order to deliver staff-location or warning signals.

13. A system according to claim 11 in which a respective decoder is connected to each switching device and is adapted to control, in accordance with the coded radio signals received by the receiver, a keying pattern for switching the miner's lamp on and off in order to distinguish between warning signals and individual-location signals.

14. A system according to claim 11, in which the source of working current for the miner's lamp is a respective battery, and the first signal receiver and associated switching device are incorporated together with the respective battery in a battery casing.

15. A system according to claim 14, in which a respective receiving antenna is disposed at a position selected from the group comprising on a safety strap, on a connecting line between the battery and the miner's lamp, and on the lid of the battery container.

16. A system according to claim 11 in which relay stations each equipped with transmitting and receiving devices and adapted to amplify signal transmitted by the secondary wave-guides are located at preset distances from one another and from the said at least one base station in the mine area.

17. A device according to claim 11 or 12 in which the working-current source for the miner's lamp is a battery, and the radio receiver, switching means and switch are incorporated together with the battery in a battery casing.

18. A device according to claim 13, in which the receiving antenna is located at a position selected from the group comprising on a carrying strap, on a connecting line between the battery and the miner's lamp, and on a lid of the battery casing.

19. A staff-location and signalling system in combination with a voice and signalling system for mines, the combination comprising:

an exchange;

at least one base station in voice communication with the exchange and located in the mine area and comprising a transmitting and receiving device with associated antenna means and adapted to be selectively coupled via at least one secondary wave guide to at least one radio telephone set in the mine area in order to produce radio telephone traffic:

at least one relay station adapted to amplify radio signals transmitted via the secondary wave guide and located at preset distances from one another and from the said at least one base station in the mine area;

a plurality of first signal receivers, each adapted to be carried together with a respective miner's lamp by miners in the mine area and each adapted to respond to coded radio signals transmitted by a said base station via the secondary wave guide in the mine area to be received by an antenna of a said first signal radio receiver, the signal receivers each having a respective switching device coupled to the radio receiver and adapted to open and close a working-current circuit connecting the associated miner's lamp to a working-current source; and at least one signal receiver associated with at least one respective group of lamps in a general mine lighting system and adapted to respond to the coded radio signals, the second signal transmitter having a signal input and a signal output and being adapted to receive signals transmitted from a said base station via the signal input, and further comprising a switching device coupled to the said signal output and adapted to open and close the supply-current circuit of the said at least one group of lamps in accordance with the coded radio signals, as a result of which the miner's lamps actuated by the first signal receivers and also the lamps in the general lighting system actuated by the second signal receivers can be switched on and off in accordance with the coded radio signals transmitted by the base station, so as to deliver staff-location and warning signals.

* * * * *